US006727860B1

(12) United States Patent
Svensson et al.

(10) Patent No.: US 6,727,860 B1
(45) Date of Patent: Apr. 27, 2004

(54) DISTRIBUTION NETWORK WITH OVERLAPPING BRANCHES AND ANTENNA ARRANGEMENT COMPRISING SUCH A DISTRIBUTION NETWORK

(75) Inventors: Bengt Svensson, Mölndal (SE); Göran Snygg, Partille (SE); Emil Wikgren, Askim (SE); Lars Manholm, Göteborg (SE); Per Holmberg, Göteborg (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/657,179

(22) Filed: Sep. 7, 2000

(30) Foreign Application Priority Data

Sep. 8, 1999 (SE) ..... 9903167

(51) Int. Cl.[7] ..... H01Q 13/22; H01P 5/12
(52) U.S. Cl. ..... 343/771; 333/125; 333/137
(58) Field of Search ..... 333/114, 113, 333/125, 137; 343/776, 771

(56) References Cited

U.S. PATENT DOCUMENTS 5,079,561 A * 1/1992 Park ..... 333/114
5,543,810 A * 8/1996 Park ..... 333/114

FOREIGN PATENT DOCUMENTS

| | | | | |
|---|---|---|---|---|
| EP | 0 788 186 A1 | | 8/1997 | |
| JP | 373601 | * | 3/1991 | ..... 343/776 |
| JP | 4105404 | * | 4/1992 | ..... 333/125 |
| JP | 4-358405 A | | 12/1992 | |
| WO | 8702186 | * | 4/1987 | ..... 333/125 |

* cited by examiner

*Primary Examiner*—Benny T. Lee
(74) *Attorney, Agent, or Firm*—Nixon & Vanderhye P.C.

(57) ABSTRACT

The invention relates to a distribution network for electromagnetic signals, preferably for use in an antenna arrangement in the microwave range, comprising at least two waveguide branches, in which branches the electromagnetic signals propagate in different directions in relation to one another. The invention is characterized in that the at least two waveguide branches overlap one another at one point in the distribution network. The waveguide branches in the distribution network which overlap one another are preferably neighboring branches and have at lease one aperture in the part of the branch which overlaps the other branch.

14 Claims, 6 Drawing Sheets

DISTRIBUTION NETWORK WITH OVERLAPPING BRANCHES AND ANTENNA ARRANGEMENT COMPRISING SUCH A DISTRIBUTION NETWORK

TECHNICAL FIELD

The present invention relates to a distribution network for electromagnetic signals, preferably for use in an antenna arrangement in the microwave range, and an antenna arrangement comprising such a distribution network.

PRIOR ART

In a telecommunication system, there may be a requirement for using so-called point-to-multipoint antennas. This is a type of antenna which is used for a central node in the system to be able to communicate with a plurality of other terminals in the system which are located within a certain angle sector. In other words, it is a requirement of an antenna of the said type to be able to generate a lobe which covers the desired angle sector.

Known types of antennas which are used in this connection are reflector antennas and horn antennas. These types of antennas have a common disadvantage in that they are relatively bulky which can be a disadvantage since there is often a requirement that the antennas should be able to blend in with the environment.

One type of antenna which is less bulky than reflector and horn antennas are so-called slot or aperture antennas. As indicated by the name, these are antennas which comprise radiating elements in the form of slots or apertures. Such radiating elements can also be used for feeding so-called patch antennas.

A radiating element of this type is fed from a distribution network which normally has branches from one or more feed points from which the distribution network is provided with energy. A normal method of producing an aperture antenna is to construct the distribution network in waveguide technology and to arrange apertures along the branches of the distribution network. For the apertures to be excited, it is necessary that they are arranged eccentrically with respect to an imaginary centre line in the longitudinal direction of the distribution network. The eccentrically arranged apertures should also be arranged alternately with respect to the imaginary centre line. The eccentric placement of the apertures with respect to the feed network, which is necessary for them to function as antenna elements, however, entails a number of disadvantages, above all that a high degree of cross polarization between the antenna elements is produced, above all in vertical polarization. In antennas with horizontal polarization, the phenomenon of cross polarization is troublesome above all in systems which require a wide bandwidth in the antenna.

EP 788 186 discloses a device for use in antenna units, such device comprising a first feeder network in stripline or microstrip technology, said first feeder network being laterally separated from a ground plane by an electrically isolating bearer. The ground plane comprises a number of apertures which are excited by the first feeder network. An improvement element of this device would be to decrease its height.

SUMMARY

The problem which is solved by the present invention is thus to provide a distribution network for electromagnetic signals, preferably for use in an antenna arrangement in the microwave range, which makes it possible to obtain lower cross polarization than in distribution networks of the waveguide type previously known. A further problem which is solved by the present invention is to bring about a distribution network for electromagnetic signals, possibly for use in an antenna arrangement in the microwave range, which gives a lower degree of cross polarization in wideband antennas than distribution networks of the waveguide type previously known.

These problems are solved with the aid of a distribution network for electromagnetic signals, preferably for use in an antenna arrangement in the microwave range, comprising at least two waveguide branches, in which branches the electromagnetic sinals propagate in different directions with respect to one another, the at least two waveguide branches overlapping one another at one point in the distribution network. The branches which overlap one another are suitably neighbouring branches in the distribution network.

Since the branches in a distribution network according to the invention overlap at at least one point, an aperture which is arranged in one branch can be placed in such a manner that it is eccentrically arranged with respect to its branch in relation to an aperture in another branch.

In the at least two branches, at least one aperture each is preferably arranged in the part of the branch which overlaps the other branch and in a particularly preferred embodiment of a distribution network according to the invention, at least one aperture is included in the at least two branches in a group of apertures which are arranged in an essentially straight line. This placement of the apertures has the effect that an extremely low degree of cross polarization is obtained. Suitably, the apertures in the waveguide branches face the same direction.

Another advantage of the invention is that an antenna with a distribution network according to the invention can be constructed with only one radiating element per branch in the distribution network. The result is that each branch can be constructed especially for "its" aperture which is a great advantage if it is desirable to form the radiation pattern of the antenna in a certain way. To have only one radiating element per branch in the distribution network also gives the antenna a greater bandwidth.

BRIEF DESCRIPTION OF THE FIGURES

The invention will be described in greater detail below with the aid of examples of embodiments, referring to the attached drawings, in which.

DETAILED DESCRIPTION OF THE PREFERRED EMBODIMENTS

Figure 1:
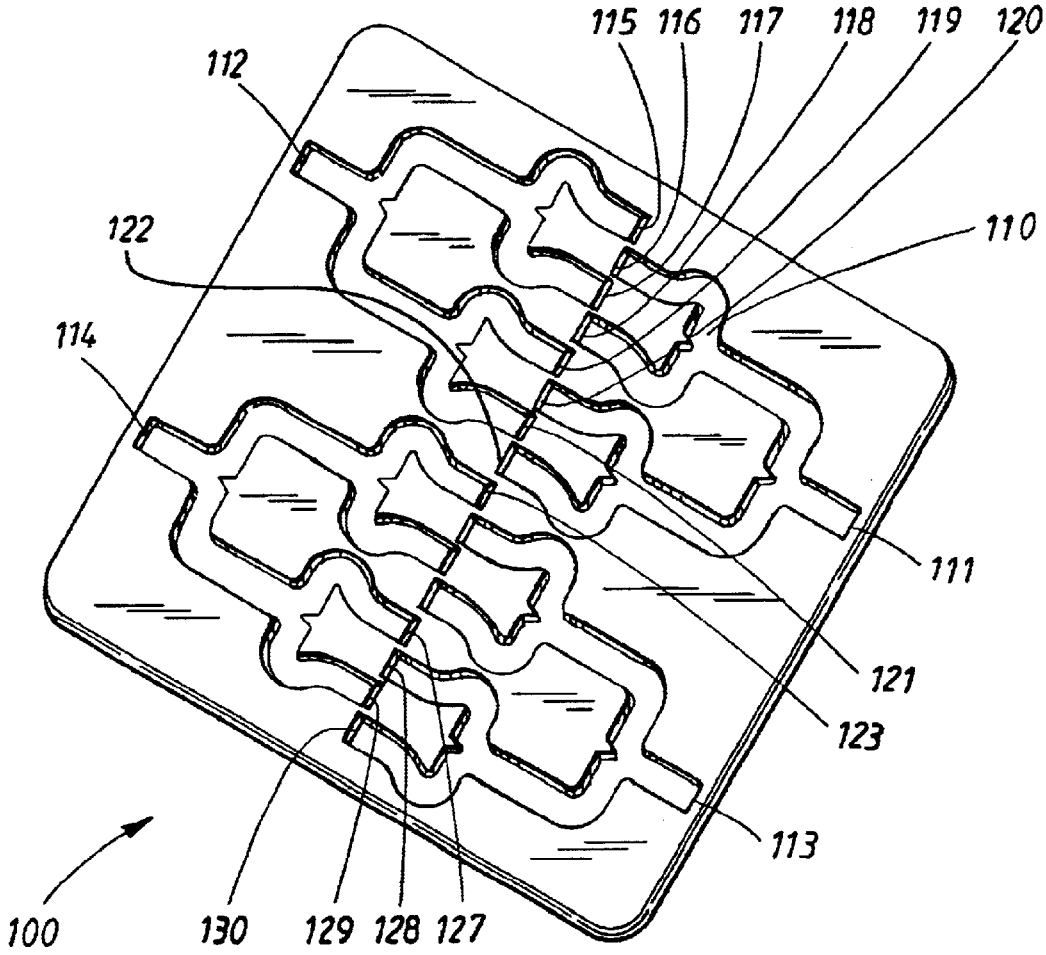
FIG. 1 shows a feeding network for horizontal polarization according to the invention.

Referring now more particularly to the accompanying drawings in which like reference numerals indicate like parts/elements throughout the several views.

FIG. 1 shows a view straight from the front of a distribution network according to the invention intended to be used in an antenna in the microwave range. In the embodiment shown in FIG. 1, the distribution network comprises grooves 110 in a plate 100 of a conductive material, which grooves, are in turn part of a waveguide structure which will be explained in greater detail below.

In the text which follows, a distribution network according to the invention will be described as a part of an antenna for transmitting electromagnetic signals. Certainly, such an antenna is reciprocal, in other words it can also be used for receiving, a fact which will not be discussed in the description since it is obvious to those skilled in the field. In the receiving function, the distribution network will conduct energy from the radiating elements and thus is more a combining network than a distribution network.

Electromagnetic energy is conducted to the distribution network via feed points 111, 112, 113, 114 in a manner which will be described in greater detail below. The distribution network comprises branches in the form of the grooves 110 which extend from the feed points, preferably in parallel with one another. At least two of the branches in the distribution network overlap one another at one point. The branches which overlap one another are preferably neighbouring branches.

Through-going apertures 115, 116, 117, 118, 119, 120, 121 and 122, preferably in the shape of slot, intended to constitute radiating elements in the antenna, are arranged in the part of a respective branch which overlaps the neighbouring branch. It is suitably the end of the branches which overlaps a corresponding part of a neighbouring branch/neighbouring branches which means that the respective radiating element will end up at the end of its branch. It is noted that like reference numerals 115, 116, 117, 118, 119, 120, 121 and 122, numerals 123, 127, 128, 129 and 130 also refer to through-going apertures.

Due to this placement of the radiating elements, they will be conceived as being eccentrically placed with respect to their respective branches, with the result that they will be excited, whereby the desired function can be achieved.

The antenna in which the plate 100 is intended to be used is an antenna for horizontal polarization, as a result of which the apertures are arranged at essentially right angles with respect to the main direction of extent of the branches in the distribution network.

As can be seen from FIG. 1, the radiating elements 115–122 form a group in which the radiating elements are arranged in an essentially straight line, which brings about an extremely low level of cross polarization. Thus with the aid of the invention, the radiating elements can thus be placed in such a manner with respect to the distribution network that they are excited, and also have low cross polarization.

The waveguides naturally do not need to be constructed by grooves in a plate, but can be constructed in a large number of other ways of constructing waveguides which are well known to those skilled in the field.

Figure 2:
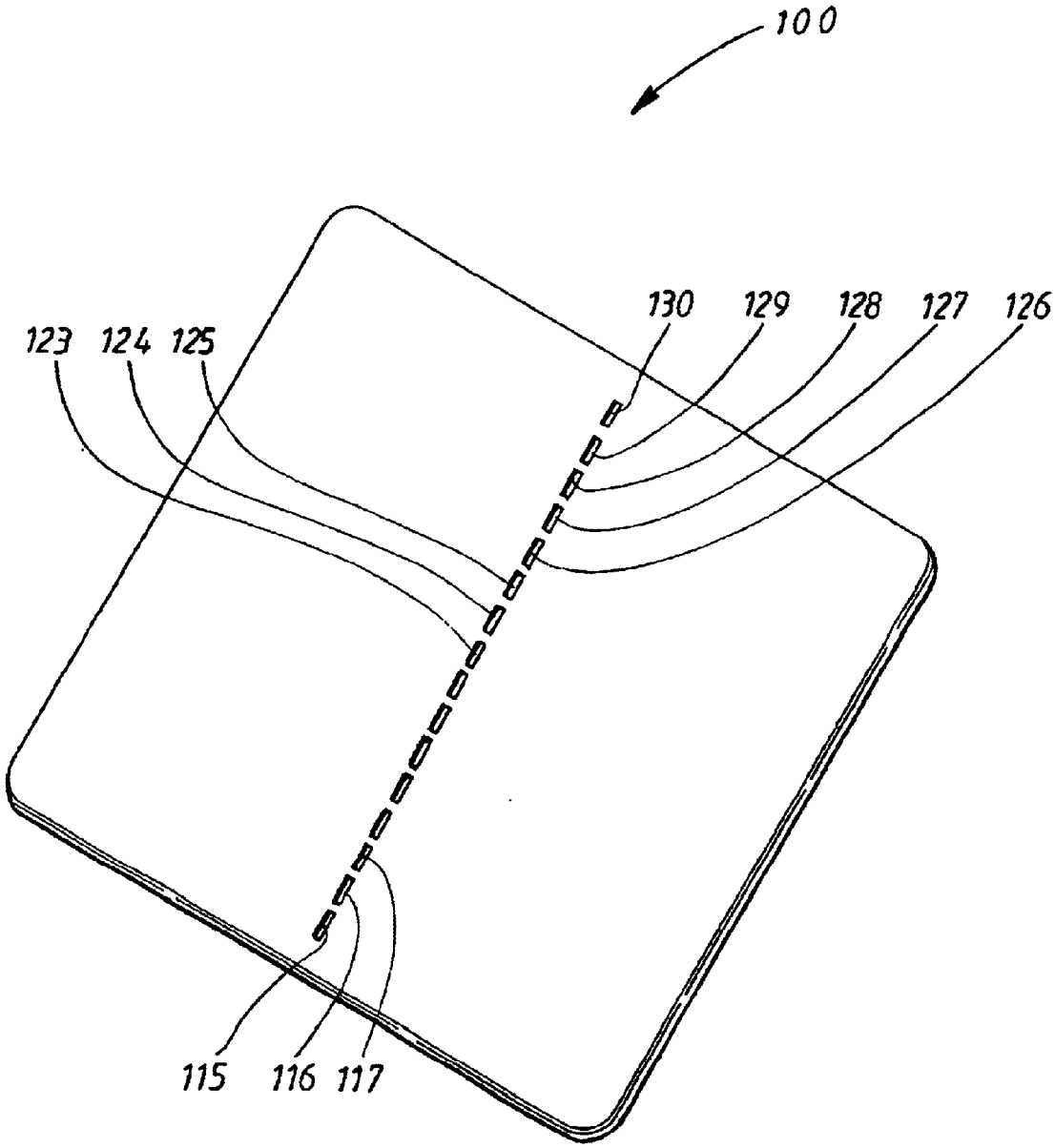
FIG. 2 shows a front view of an antenna arrangement according to the invention for horizontal polarization.

FIG. 2 shows the same plate 100 as in FIG. 1 seen, from the reverse. This picture shows even more clearly the placement of the radiating elements in a group along an essentially straight line. In the embodiment shown in FIGS. 1 and 2, all apertures are orientated in the same direction which means that they are intended for one and the same polarization, horizontal polarization in the example shown.

Figure 3:
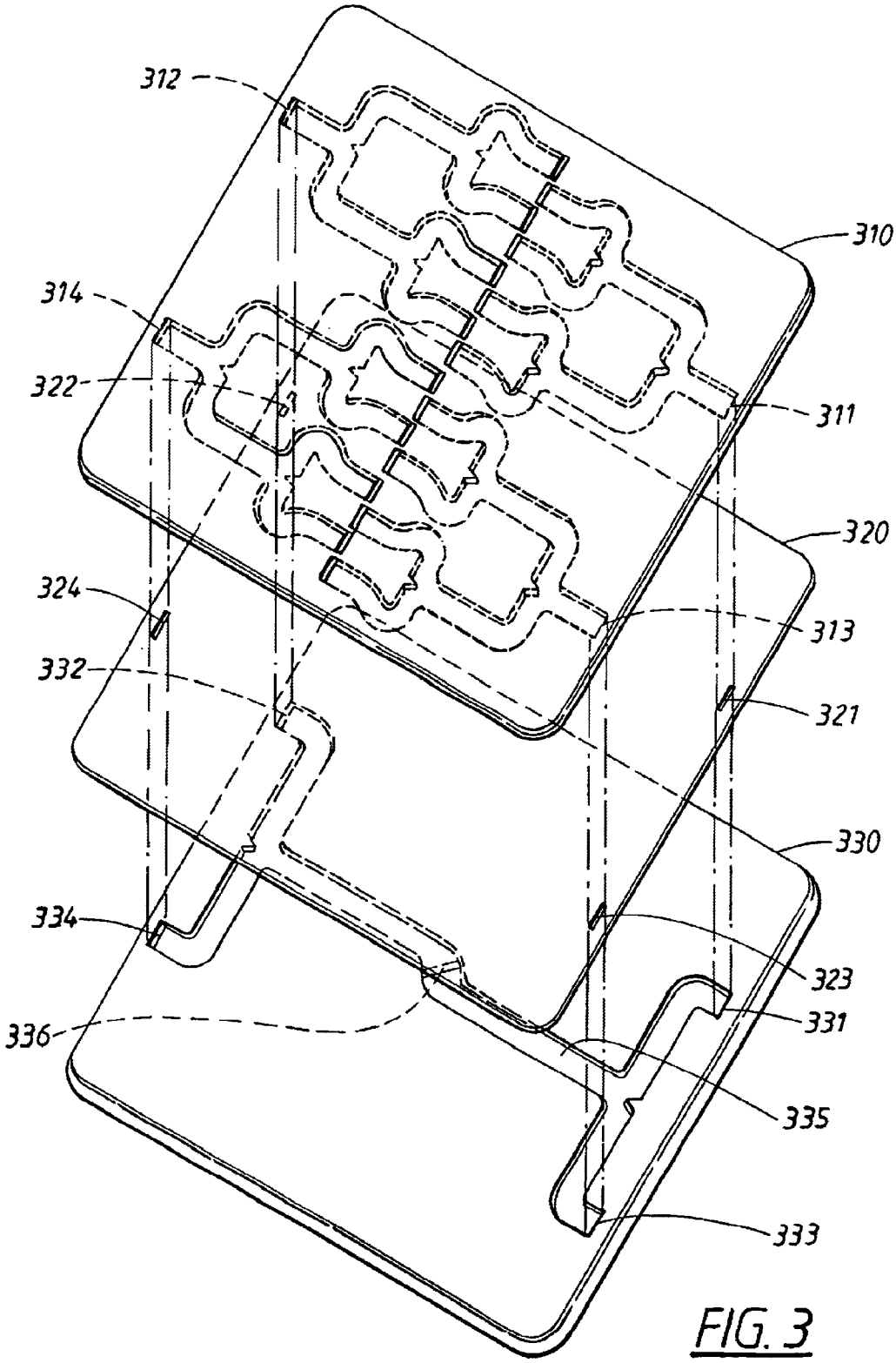
FIG. 3 shows a plate structure for construction of a distribution network according to the invention.

FIG. 3 shows how an antenna with a distribution network according to the invention, in a preferred embodiment, is designed using a plate structure consisting of separate plates 310, 320, 330 which wholly or partially consist of electrically conductive material. The number of plates in the example shown is three which naturally should only be seen as an example, it will be clear to those skilled in the field that the invention can be built up by a largely optional number of such plates.

The plates 310, 320, 330 in FIG. 3 are part of the same type of antenna for electromagnetic signals as has been described in connection with FIGS. 1 and 2. Since the plate 310 in FIG. 3 shows the same plate as FIG. 1, it will not be described again in detail here.

Electromagnetic signals are conducted into the distribution network in plate 310 via a number of feed points 311, 312, 313, 314 from a corresponding number of apertures 321, 322, 323, 324 which are located in a plate 320 which is arranged on the side of the plate 310 which shows the grooves in the plate 310 mentioned in connection with FIG. 1.

The plate 320 is designed in such a manner that, when it is arranged on the said side of the plate 310, the grooves in the plate 310, together with the surfaces of the plate 320 which are lying against the grooves will form waveguides. The plate 320 can either have an essentially flat construction as shown in FIG. 3, with exception of the apertures which conduct energy to the plate 310, the surfaces of the plate 320 which lie against the grooves in the plate 310 forming one of the walls in the waveguides. In this case, the plate 320, in contrast to the plate 310, has the same construction, in principle, on both of its sides and can be said to constitute an aperture layer situated between two layers in the distribution network.

An alternative construction, not shown, of the plate 320 is to provide this plate also with a number of grooves intended to form waveguides together with the grooves in the plate 310.

Electromagnetic signals are conducted to the apertures 321, 322, 323, 324 in the plate 320 from a second layer 335 in the distribution network, located in plate 330. The distribution network 331 in plate 330, like the distribution network in plate 310, comprises a number of grooves which will constitute parts of waveguides. In the example shown in FIG. 3, the plate 330 has a single coherent groove, but those skilled in the filed will know that the same result can be produced with a plurality of other combinations of grooves.

The plate 330 is arranged in such a manner that its grooves are lying against the plate 320 and form waveguides together with the surfaces in the plate 320 which are lying against the grooves. What has been said above about the construction of the side of the plate 320 lying against the plate 310 also applies to the side of the plate 320 lying against the plate 330.

When the plate 320 is arranged against the plate 330, the apertures 321, 322, 323, 324 in the plate 320 will be located directly in front of a number of feed points 331, 332, 333, 334 in the plate 330, from which feed points electromagnetic signals are conducted to the apertures in the plate 320 and further up into the distribution network in the plate 310.

The electromagnetic signals enter the distribution network in the plate 330 through a connection and feed point 336 in the distribution network. At this point, the distribution network is suitably connected to the external equipment with which it is intended to cooperate, such as, for example, a telecommunication system.

It has not been described above how the plates in FIG. 3 are joined together and held together, but this can be done in a large number of ways known to those skilled in the field. For example, screws, soldering and gluing can be mentioned.

Figure 4:
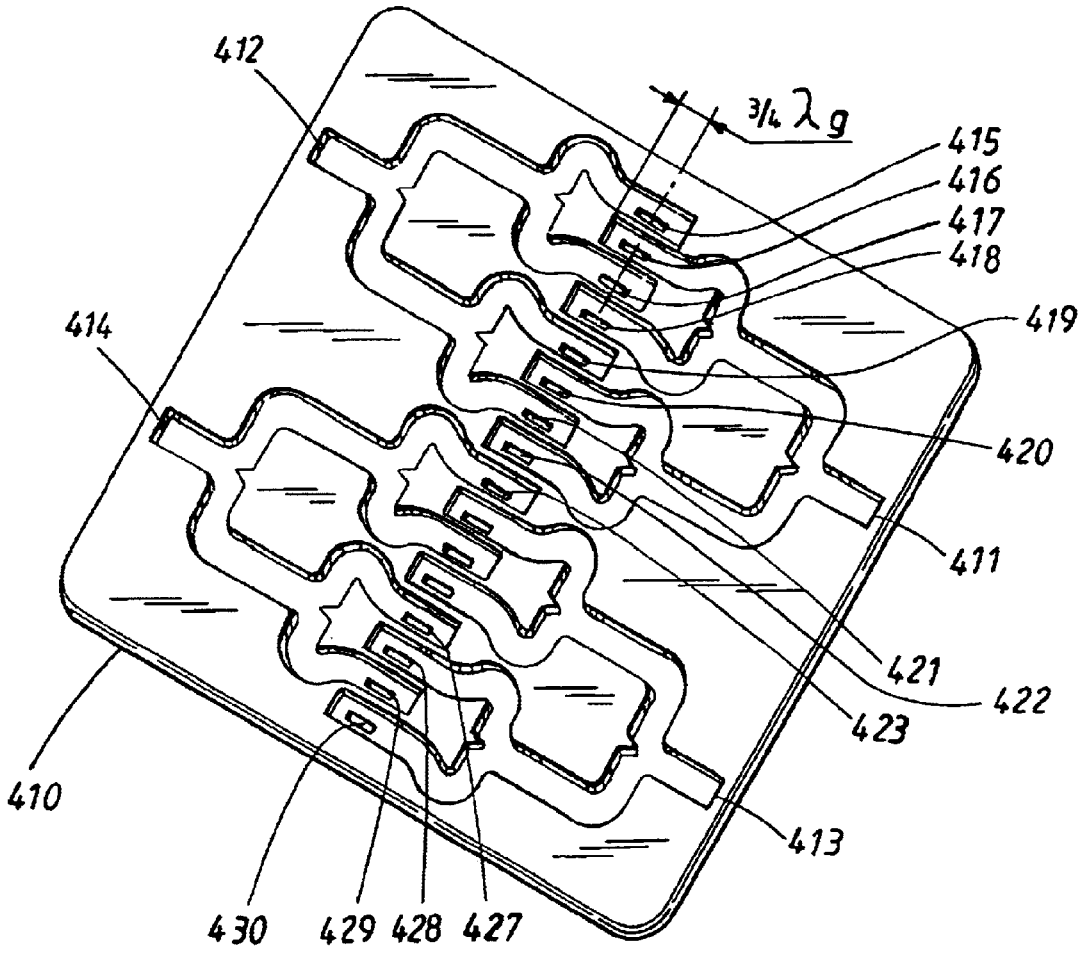
FIG. 4 shows a feeding network for vertical polarization according to the invention.

FIG. 4 shows an alterative 410 to the plate 100 in FIG. 1 and the plate 310 in FIG. 3 intended to be included in an antenna arrangement for vertical polarization. What has been described above concerning the plates 100 and 310 also applies to the plate 410, with the difference that since the antenna, in which the plate is to be included, is an antenna for vertical polarization, the apertures 415, 416, 417, 418, 419, 420, 421 and 422 in the plate 410 have the same main direction of extension as the branches in the distribution network.

Furthermore, according to the invention, the apertures 415, 416, 417, 418, 419, 420, 421, 422, 423 . . . 427, 428, 429 and 430 in the plate 410 are placed at a distance of $\frac{3}{4}\lambda_g$ from the end point of their respective branch, where $\lambda_g$ is the wavelength of the electromagnetic signal in the waveguide. This distance is $\frac{1}{2}\lambda_g$ more than normal but provides good characteristics, for example with respect to the bandwidth of the antenna. As in the FIG. 1 embodiment, energy is conducted to the distribution network via feed points 411, 412, 413 and 414 (see points 111–114 in the FIG. 1 embodiment discussed above).

Figure 5:
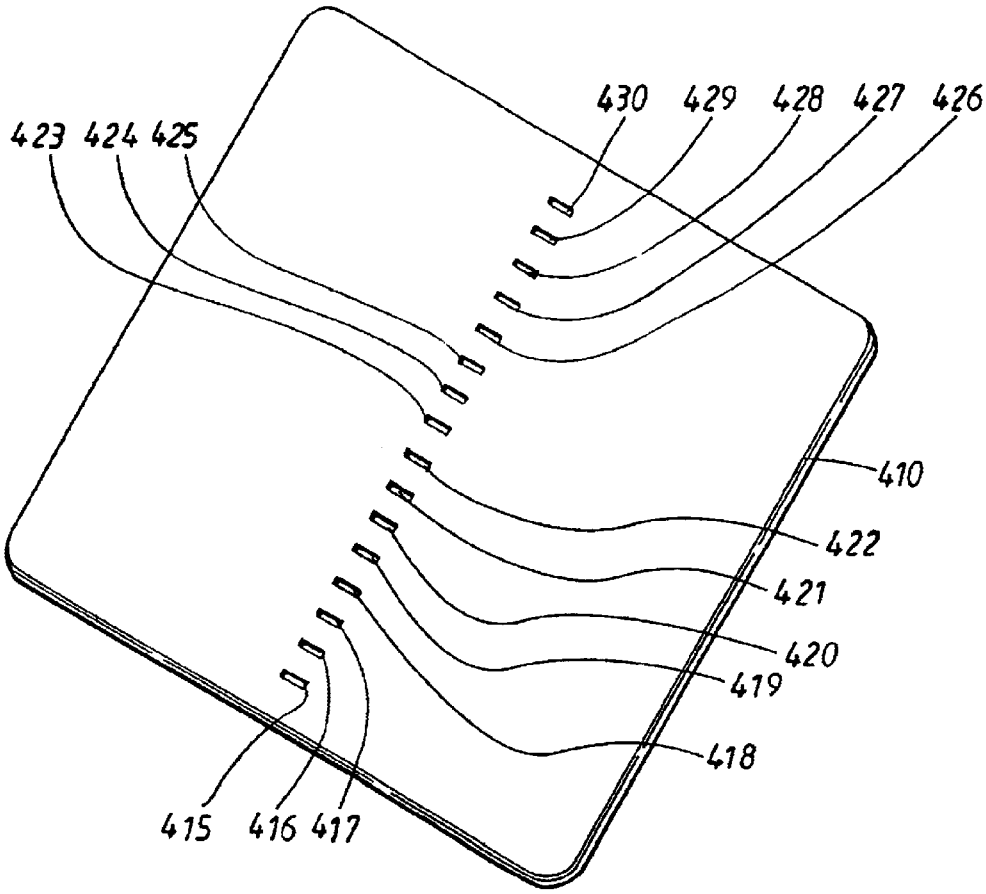
FIG. 5 shows a front view of an antenna arrangement according to the invention for vertical polarization.

FIG. 5 shows, like FIG. 2, the plate with grooves on its reverse side. As can be seen in FIG. 5, the apertures 415, 416, 417, 418, 419, 420, 421, 422, 423, 424, 425, 426, 427, 428, 429 and 430 are also preferably arranged as a group in the vertically polarized antenna, along an essentially straight line, which provides a low degree of cross polarization.

In a preferred embodiment, an antenna with a distribution network according to the invention, intended for vertical polarization, can be built up by a plate structure consisting of separate plates similar to what has been shown in connection with FIG. 3 above. The aperture layer and the second distribution network is then built up of plates which are constructed as the plates 320, 330 in FIG. 3, which is why these will not be described again here.

Since a distribution network according to the invention provides the possibility of creating an antenna with only one radiating element per branch in the distribution network, great possibilities are obtained for forming the radiation pattern of the antenna by individually constructing each branch so that the desired amplitude and phase of the signals are obtained from the radiating element of the branch.

Figure 6A:
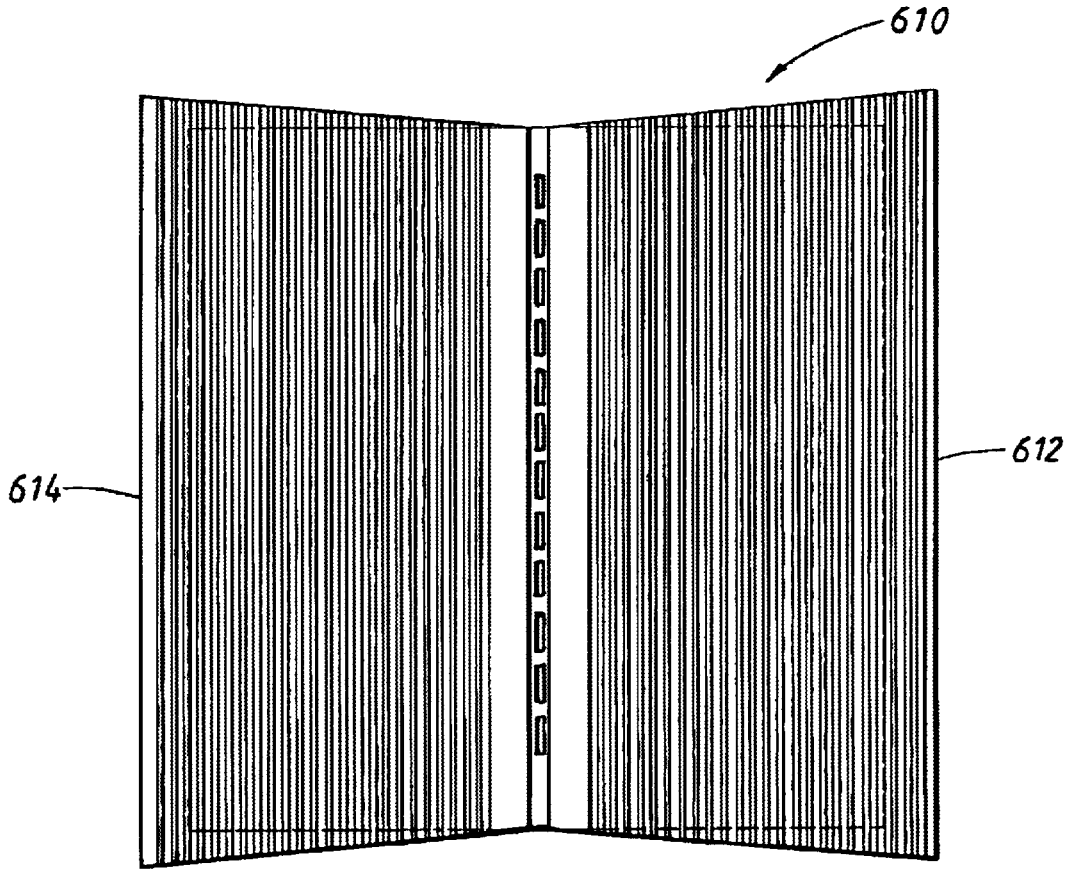
FIGS. 6*a* and 6*b* show an arrangement with the aid of which the antenna pattern of an antenna according to the invention can be formed.
Figure 6B:
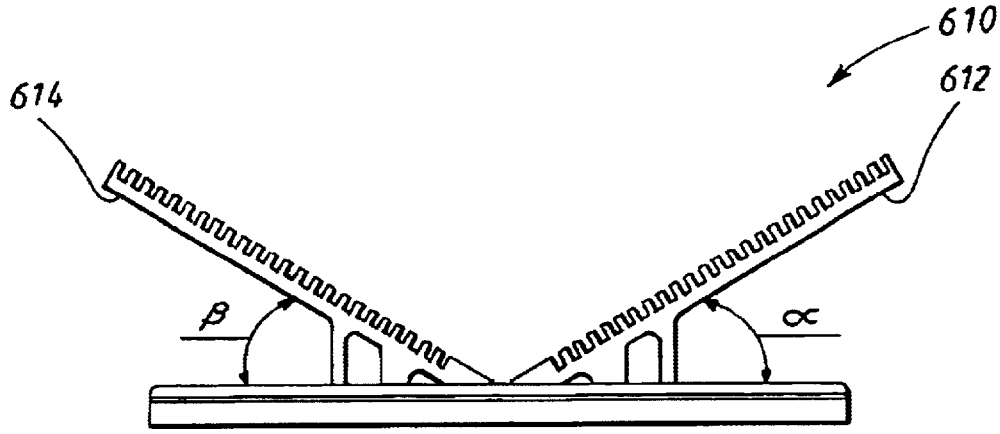

One way of further forming the antenna pattern in an antenna with a distribution network according to the invention as shown in FIGS. 6*a* and 6*b*. The antenna 610 shown is horizontally polarized but the principle can also be applied to a vertically polarized antenna. The antenna 610 in FIGS. 6*a* and 6*b* has been provided with so-called baffles 612, 614 which are elements constructed of electrically conductive material arranged on each side of the straight line along which the radiating elements of the antenna are arranged at a certain angle $\alpha$, $\beta$ with respect to the plane which is defined by the plate in which the radiating elements are arranged.

FIG. 6*a* shows an antenna 610 with baffles straight from the front, FIG. 6*b* shows the same antenna lying down, seen in a direction which coincides with the straight line along which the apertures are arranged.

The invention is not limited to the embodiments specified above but can be freely varied within the context of the patent claims following. For example, the plates of a conductive material which have been described above can be plates in a non-conductive material such as plastic which has been made conductive by coating parts of the surface with a conductive material.

What is claimed is:

1. Distribution network for electromagnetic signals for use in an antenna arrangement in the microwave range, the distribution network comprising:

at least first and second waveguide branches comprised of respective grooves defined in a plate of conductive material, in which branches the electromagnetic signals propagate in different directions with respect to one another so that the signals in the first branch propagate in a first direction and signals in the second branch propagate in a second direction different from the first direction, wherein said first and second waveguide branches overlap one another at a point in the distribution network, said first and second waveguide branches each having at least one through-going aperture in the part of the branch which overlaps the other branch, said through-going apertures extending all the way through the plate of conducting material and each aperture being arranged essentially at a right angle with respect to a main direction of extent of the corresponding branch; and wherein the apertures in the branches serve as radiating elements of the antenna arrangement in which the distribution network is used.

2. Distribution network according to claim 1, in which the first and second waveguide branches in the distribution network which overlap one another are neighbouring branches.

3. Distribution network according to claim 1, in which at least one aperture in the each of the first and second waveguide branches is included in a group of apertures which are arranged in an essentially straight line.

4. Distribution network according to claim 3, in which a number of the apertures in the group are for the same polarization.

5. Distribution network according to claim 4, in which the apertures in the group are intended for horizontal polarization.

6. Distribution network according to claim 5, in which the apertures in the group are situated at the end of the respective branch in the distribution network.

7. Distribution network according to claim 4, in which the apertures in the group are intended for vertical polarization.

8. Distribution network according to claim 7, in which the apertures in the group are situated at a distance of $\frac{3}{4}\lambda_g$ from the end point of their respective branch, where $\lambda_g$ is the wavelength of the electromagnetic signal in the waveguide.

9. Distribution network according to claim 8, in which the apertures are constituted of apertures in a longitudinal wall of the waveguide.

10. Distribution network according to claim 1, in which the apertures comprise slots.

11. Distribution network according to claim 1, in which the waveguides comprise tracks in the plate of conductive material.

12. Antenna arrangement comprising a distribution network for electromagnetic signals, the antenna arrangement comprising:

at least first and second waveguide branches comprised of respective grooves defined in a plate of conductive material, in which branches the electromagnetic signals propagate in different directions with respect to one another so that the signals in the first branch propagate in a first direction and signals in the second branch propagate in a second direction different from the first direction, wherein said first and second waveguide branches overlap one another at a point in the distribution network, said first and second waveguide branches each having at least one aperture in the part of the branch which overlaps the other branch, said apertures extending through the plate and each aperture being arranged essentially at a right angle with respect to a main direction of extent of the corresponding branch; and wherein apertures in the branches serve as radiating elements of the antenna arrangement.

13. Antenna arrangement according to claim 12, in which the distribution network is comprised of two layers with an intermediate aperture layer.

14. Antenna arrangement according to claim 13, in which the waveguides in one of the distribution networks comprises tracks in the plate of conductive material.

* * * * *